US005846105A

United States Patent [19]

Baker et al.

[11] Patent Number: 5,846,105

[45] Date of Patent: Dec. 8, 1998

[54] MARINE JET PROPULSION WATER INLET SYSTEM

[75] Inventors: Jeffrey L. Baker, Palm City; Eric D. Hess, Jensen Beach; Arthur G. Manchester, Stuart, all of Fla.

[73] Assignee: Outboard Marine Corporation, Waukegan, Ill.

[21] Appl. No.: 901,922

[22] Filed: Jul. 29, 1997

[51] Int. Cl.[6] ..... B63H 11/01

[52] U.S. Cl. ..... 440/46; 440/38

[58] Field of Search ..... 440/46, 38, 40–43, 440/47

[56] References Cited

U.S. PATENT DOCUMENTS

| | | | |
|---|---|---|---|
| 2,149,155 | 2/1939 | Anderson | 440/47 |
| 3,279,414 | 10/1966 | Rabald | 440/46 |
| 3,827,390 | 8/1974 | De Vault | 440/43 |
| 4,449,944 | 5/1984 | Baker et al. | 440/47 |
| 5,114,368 | 5/1992 | Moyle et al. | 440/38 |
| 5,281,177 | 1/1994 | Dickinson et al. | 440/47 |

FOREIGN PATENT DOCUMENTS

| | | | |
|---|---|---|---|
| 3-65490 | 3/1991 | Japan | 440/46 |
| 4-243687 A | 8/1992 | Japan | 440/46 |

*Primary Examiner*—Sherman Basinger
*Attorney, Agent, or Firm*—Jones, Day, Reavis & Pogue

[57] ABSTRACT

A marine jet propulsion water inlet system having panels extending from the inlet opening at the bottom of a watercraft downstream, upward and rearwardly, in the water channel. The panels extend to the upper wall of the water channel or are integral with the upper wall. In this way, aquatic vegetation and debris will not have any surface to wrap around. This results in greatly reduced clogging of the water channel. The panels are also integral with downwardly extending fins which are beneath the bottom of the watercraft and which have edges that are also designed to direct vegetation and debris along the fin and pass the craft to reduce or eliminate the adhesion of vegetation and debris.

22 Claims, 11 Drawing Sheets

MARINE JET PROPULSION WATER INLET SYSTEM

BACKGROUND OF THE INVENTION

1. Field of the Invention

The present invention relates to a water inlet system and, more particularly, to a water inlet system for a watercraft powered by a marine jet propulsion unit where the inlet system resists clogging by aquatic vegetation and debris.

2. Description of the Related Art

A marine jet propulsion system is usually an integrated unit including an engine, a drive shaft, an impeller and an exhaust housing which is installed in a specifically designed opening in a watercraft. Thrust is generated by passing water through a water channel extending from an inlet formed in the bottom of the craft and sloping upwardly and rearwardly to the impeller. The impeller pushes the water through the exhaust extending aft of the stern of the craft. In this system the impeller acts as a pump.

A major problem with jet propulsion watercraft is that aquatic vegetation and debris often get sucked into the water channel and clog this passageway so as to restrict the flow of water. Restricted water flow reduces thrust that is generated by the impeller and causes a fall-off of power. Vegetation also may entangle the impeller and thus interfere with propulsion. Another problem is that waterborne debris may be sucked into the water channel and strike the impeller causing it to be damaged.

Grates are often attached to the craft bottom covering the inlet of the water channel with the intention of blocking vegetation and debris or, at least, to restrict its entry. Typically, the grate includes bars or ribs to prevent large objects from entering the water channel, but these ribs often allow vegetation and other debris to jam or attach themselves to the grate. Again, the result is blockage of the free flow of water through the channel.

Removing vegetation and debris from the grate is an inconvenience and a bother. Sometimes vegetation can be removed from the grate simply by reversing the direction of the impeller causing water to flow backwards, from the stern toward the bow. Other times, however, the vegetation wraps itself around the ribs of the grate and must be pulled or cut away manually.

Prior attempts to develop a water inlet system that resists clogging by aquatic vegetation and debris have yet to produce an optimal system.

BRIEF DESCRIPTION OF THE INVENTION

The difficulties encountered by previous grates have been overcome by the present invention. What is described here is a marine jet propulsion water inlet system that resists clogging by aquatic vegetation and debris comprising a water channel disposed in a watercraft, with the channel having an upstream inlet in communication with an opening in the bottom of the watercraft, the channel extending downstream for passing water from outside the watercraft through the channel to an impeller mounted to the watercraft, and the channel having an upper wall, and including a vertically disposed panel extending from the upper wall of the channel and from the inlet, downstream toward the impeller.

The invention also includes a method for forming a marine jet propulsion water inlet system that resists clogging by aquatic vegetation and debris comprising forming in a watercraft a water channel having an upper wall, communicating a channel upstream inlet with an opening in the bottom of the watercraft, extending the channel downstream for allowing the passage of water from outside the watercraft through the channel to an impeller mounted to the watercraft, forming a panel within the channel, and extending the panel from the upper wall and the inlet in a direction downstream toward the impeller.

An object of the present invention is to provide a marine jet propulsion water inlet system that resists clogging by aquatic vegetation and debris. Another aspect of the present invention is to provide a marine jet propulsion water inlet system which is simple, inexpensive and reliable. A further aim of the present invention is to provide a marine jet propulsion water inlet system that is easy to manufacture, install and maintain. Still another advantage of the present invention is to provide a method for forming the marine jet propulsion water inlet system.

A more complete understanding of the present invention and other objects, aspects, aims and advantages thereof will be gained from a consideration of the following description of the preferred embodiments read in conjunction with the accompanying drawings provided herein.

DESCRIPTION OF THE PREFERRED EMBODIMENTS

Figure 1:
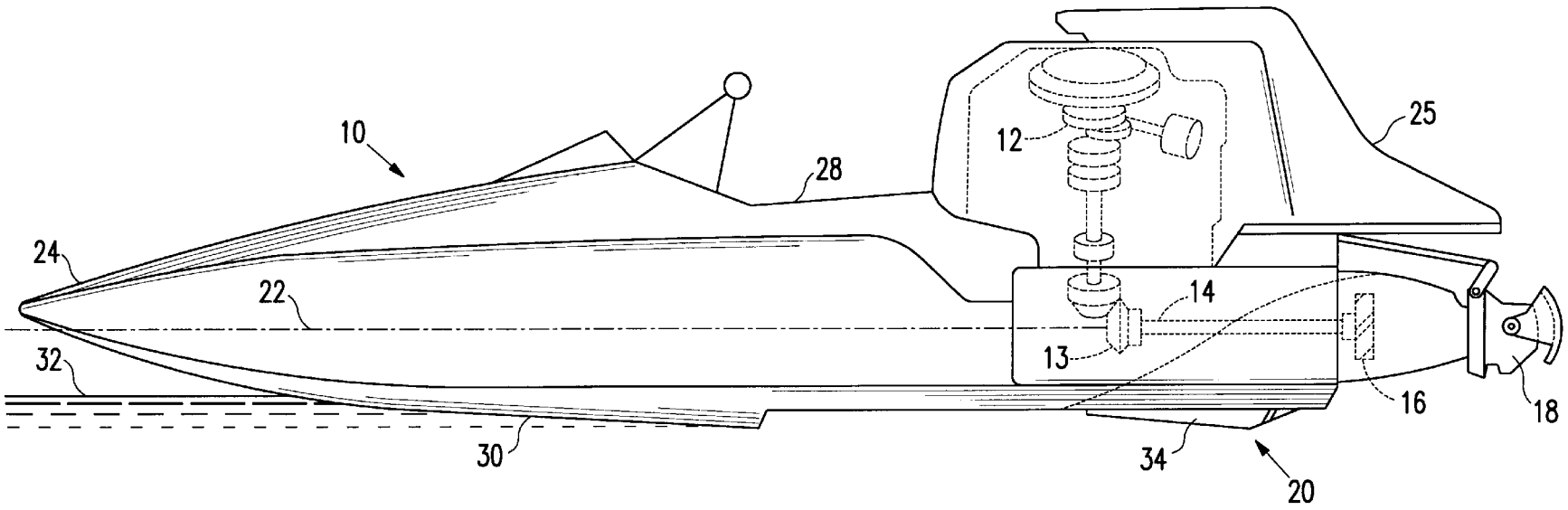
FIG. 1 is a side elevational view of a watercraft partially cut away and partially diagrammatic, illustrating a marine jet propulsion unit with an inventive water inlet system.

While the present invention is open to various modifications and alternative constructions, the preferred embodiments as shown in the drawings will be described herein in detail. It is to be understood, however, that there is no intention to limit the invention to the particular forms disclosed. On the contrary, the intention is to cover all modifications, and equivalent and alternative constructions falling within the spirit and scope of the invention as expressed in the appended claims.

Referring now to FIG. 1, there is shown a watercraft sometimes referred to as a personal watercraft or PWC 10 which is powered by a marine jet propulsion unit or jet drive system including an engine 12, a gear set 13, a drive shaft 14, an impeller 16, a directional exhaust 18 and a water inlet system 20. The watercraft may be of any design or shape and may be in the form of a motorboat, a speed boat, a yacht or the like. With the marine jet propulsion unit the watercraft is adapted to travel in very shallow water.

The PWC includes a longitudinal axis represented by the line 22, a bow 24 at its forward or upstream end and a stern 25 at its rear, aft or downstream end. The PWC also includes an operator area 28 and a bottom 30. A waterline is depicted by a line 32.

Figure 2:
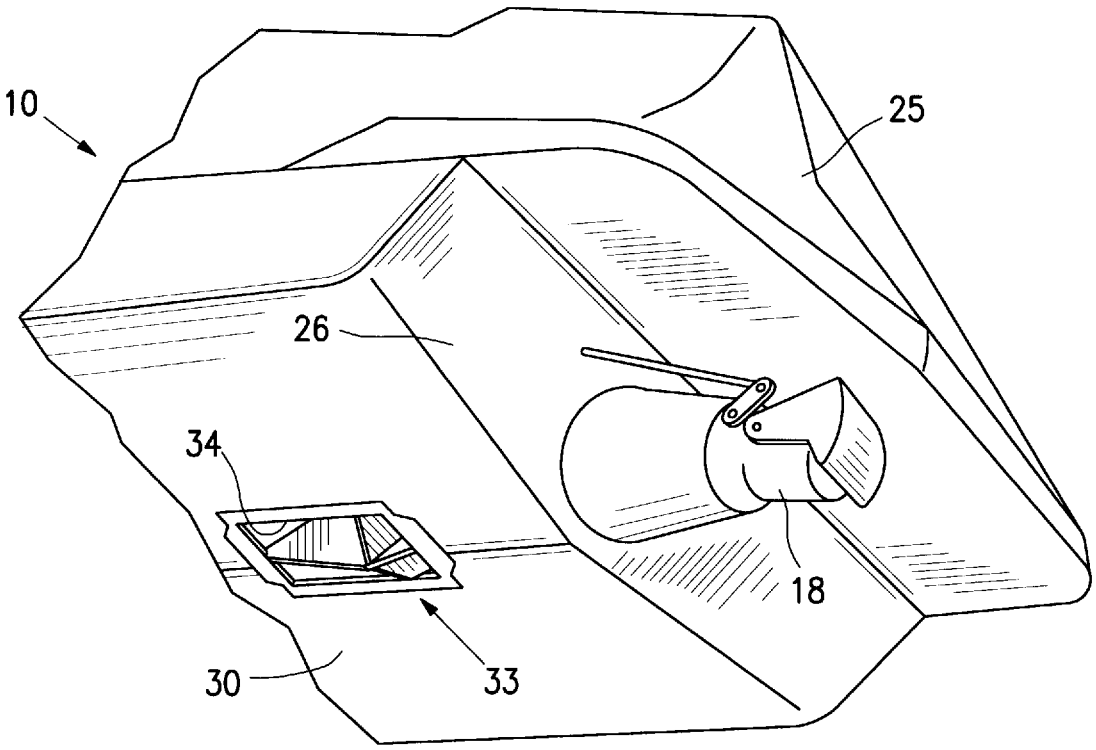
FIG. 2 is a partial perspective view of the watercraft of FIG. 1 from a position behind and beneath the watercraft.
Figure 3:
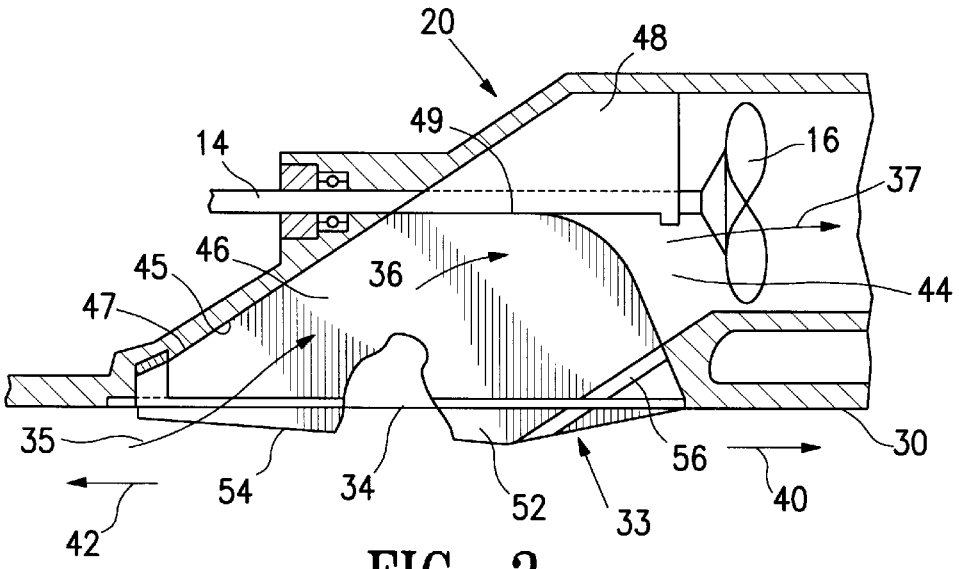
FIG. 3 is a diagrammatic side elevational view of the inventive water inlet system.
Figure 4:
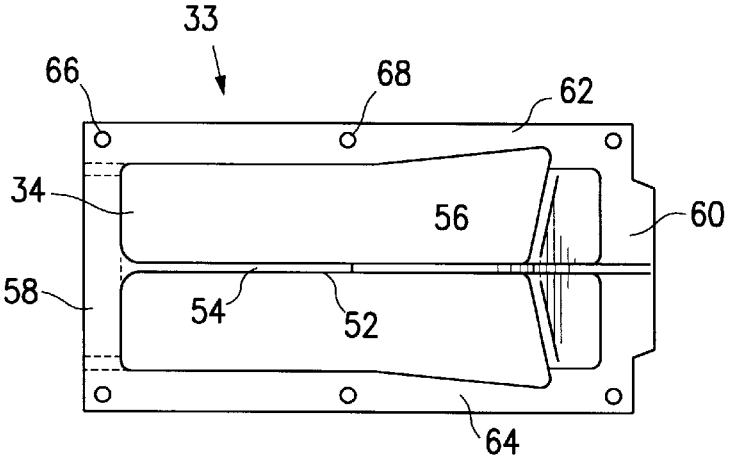
FIG. 4 is a bottom plan view of a portion of the water inlet system of FIG. 3.
Figure 5:
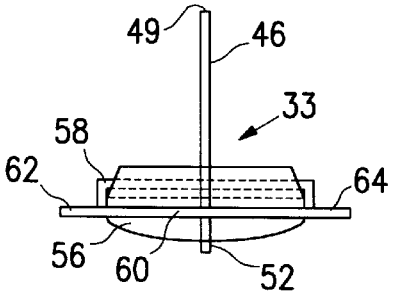
FIG. 5 is a rear or aft elevational view of a portion of the water inlet system shown in FIG. 3.
Figure 6:
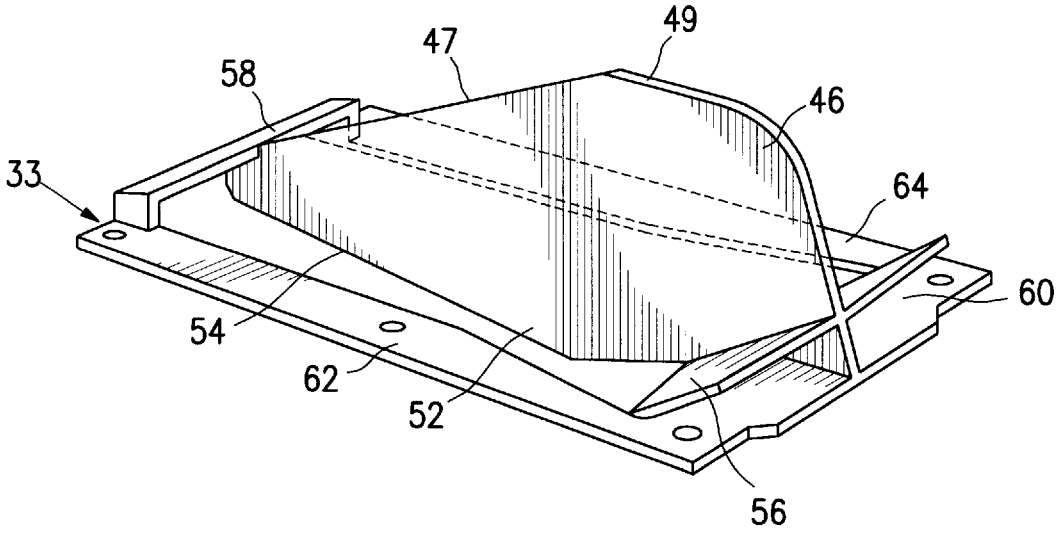
FIG. 6 is a perspective view of a portion of the water inlet system shown in FIG. 3 when viewed from a position somewhat aft and slightly above.

Referring now to FIG. 2, the stern 25 of the PWC is illustrated as it would be seen from below and behind. Also shown is the exhaust 18 of the jet propulsion system, a transom 26, the bottom 30 and a grate 33 attached to the bottom of the craft covering an upstream inlet 34 of the water channel 20.

Referring now to FIGS. 3–6, there is illustrated in more detail the water inlet system 20 of the marine jet propulsion unit. The bottom 30 FIG. 3 of the boat is illustrated for reference, the aft direction is designated by an arrow 40 and the forward direction is represented by the arrow 42. The inlet system includes a water channel 44 which is usually part of a unitary jet propulsion unit as described in relation to FIG. 1 and is often installed in the watercraft as a complete unit. Or the various parts of the jet drive may be installed separately and the water channel is molded at the time the craft's hull is made. The water channel 44 extends from the upstream inlet 34 that coincides with an opening in the bottom of the boat and extends at an upward angle downstream in the aft direction as shown by three arrows 35, 36 and 37 which represent water flow. The water channel continues pass the impeller 16 and terminates at the directional exhaust 18. The purpose of the channel is to allow ambient water surrounding the craft to move pass the impeller 16 and out the exhaust. The impeller provides the driving force for the craft and acts as a pump to suck the water from under the craft, through the channel and out through the exhaust 18. By swiveling the exhaust, the craft may be steered.

As mentioned earlier, when discussing the prior art, there is usually a grate attached to the bottom of jet drive watercraft, with the grate having parallel ribs or bars closely spaced from one another and running parallel to the longitudinal axis of the craft. The purpose of the closely spaced bars is to block waterborne debris or vegetation from being sucked in with the water and clogging or damaging the impeller. However, its been found that debris and aquatic vegetation frequently wrap themselves around the bars or simply get wedged against the bars or grate due to the forward motion of the craft. In either case, if enough vegetation or debris adheres to the grate, the passage of water will be restricted and the power output of the boat is diminished.

To solve this problem, it has been found that replacing a bar or rib with a panel prevents the adherence of vegetation and debris to a large extent. Such a panel 46 is shown in various views in FIGS. 3–6 as part of the grate 33. The panel extends from the inlet upwardly and downstream in the water channel 44 to an upper wall 45 of the channel and up against a shaft housing 48, FIG. 3, for the impeller shaft 14. The panel 46 includes an upper edge 47 that mates or abuts the upper wall 45 and an upper edge 49 that mates or abuts the shaft housing 48. The upper edges should closely approximate the geometry of the upper wall and the shaft housing.

It has been found that when a large, vertically oriented surface extending to the upper wall is presented to vegetation and debris, little of this material will attach itself and thereby clog the water channel. Either the material will be washed along the bottom of the craft or the smaller items will be passed through the water channel, passed the impeller and passed out the exhaust.

To help vegetation and debris bypass the water channel completely, a downwardly or upstream depending fin 52 is provided. This fin is an extension of the panel 46 and integral with it, and it extends beneath the bottom 30 of the craft by one to three inches for a craft 10–20 feet long. The fin may extend for a greater distance for a larger craft. By positioning the fin beneath the craft, vegetation and debris which are encountered ride or slide along a lower edge 54 of the fin and float away from the craft without ever attaching themselves.

The inlet system may also include a scoop 56 which extends slightly beneath the bottom 30 of the craft and provides a shovel-like surface for engaging the water and directing it into the water channel 44. The scoop may be omitted or the lower edge may be level with the craft's bottom or even higher than the bottom. The upper portion of the scoop may mate with the channel wall so that a continuous surface is provided as shown.

The panel 46, the fin 52 and the scoop 56 are all part of the grate 33. The grate may have a generally rectangular shaped frame with a fore member 58, an aft member 60, a port member 62 and a starboard member 64. Suitable openings in the fore, aft, port and starboard members, such as holes 66 and 68, may be used to receive fasteners (not shown) to attach the grate to the bottom of a craft. As best appreciated from FIG. 6 the panel, the fin, the grate and the scoop may be made integral by molding a synthetic resin or aluminum. Other suitable manufacturing methods may also be used, such as bonding or welding parts together. The panel 46 extends fore and aft between the members 58 and 60. Any suitable material may be used for the water channel, such as metal or resin.

Figure 7:
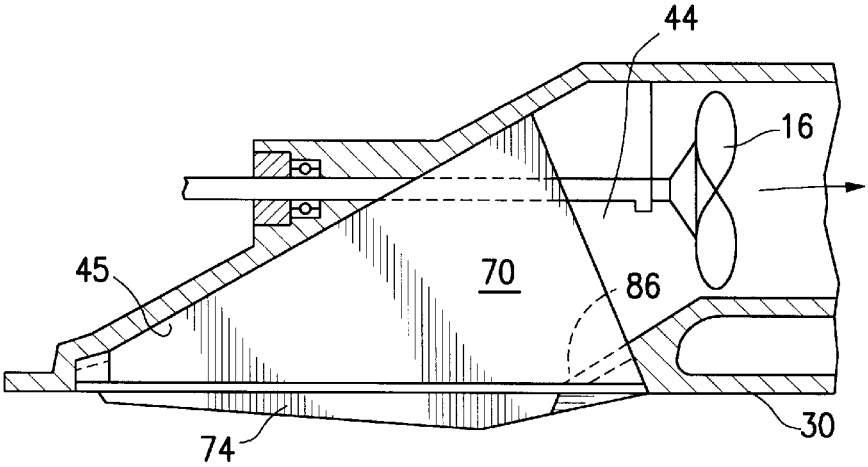
FIG. 7 is a diagrammatic side elevational view of another embodiment of the inventive water inlet system.
Figure 8:
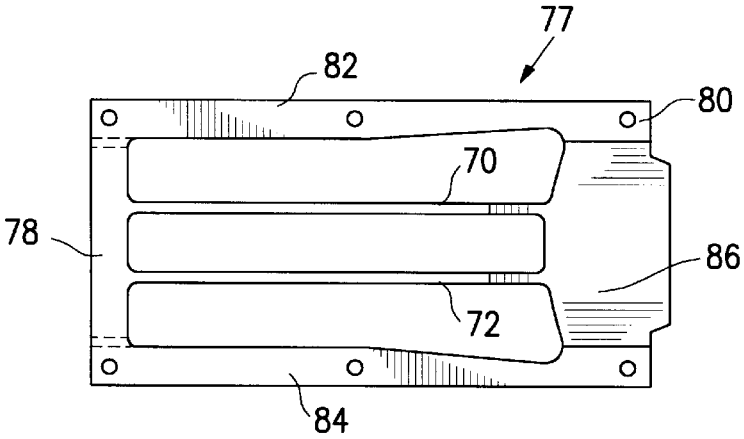
FIG. 8 is a bottom plan view of a portion of the water inlet system shown in FIG. 7.
Figure 9:
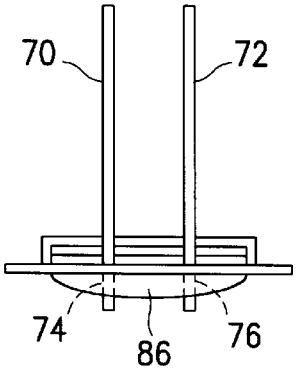
FIG. 9 is an aft elevational view of a portion of the water inlet system shown in FIG. 7.

Referring now to FIGS. 7–9 there is illustrated another embodiment of the present invention. This embodiment includes the same water channel 44 with an upper wall 45, but instead of having one panel, as illustrated previously, the FIGS. 7–9 embodiment has two panels 70 and 72. The panels have a generally triangular shape and extend further along the upper wall 45 because the two panels straddle the impeller shaft housing 48. Each panel is also integral with a fin, such as the fin 74 integral with the panel 70 and the fin 76 integral with the panel 72.

As with the earlier embodiment, the FIGS. 7–9 embodiment includes an integral grate 77 having a frame with a fore member 78, an aft member 80, a port member 82 and a starboard member 84. A scoop 86 is also integrally formed adjacent the aft member 80.

Figure 10:
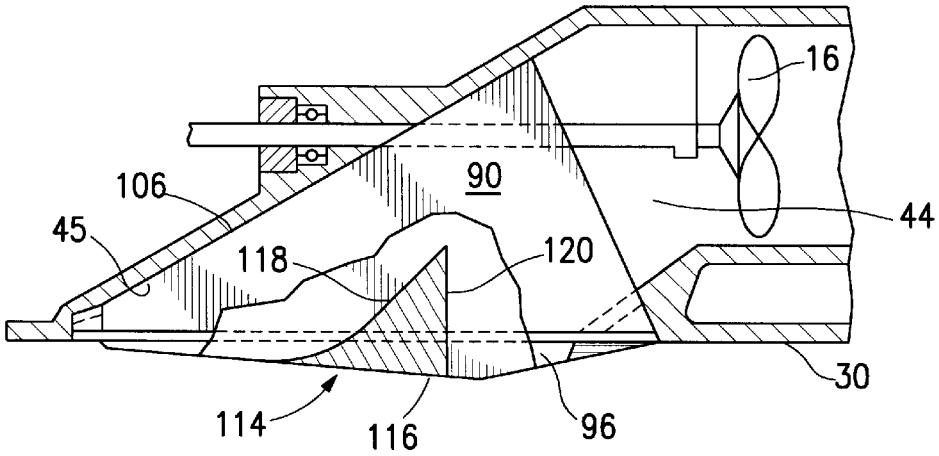
FIG. 10 is a diagrammatic side elevational view of yet another embodiment of the inventive water inlet system.
Figure 11:
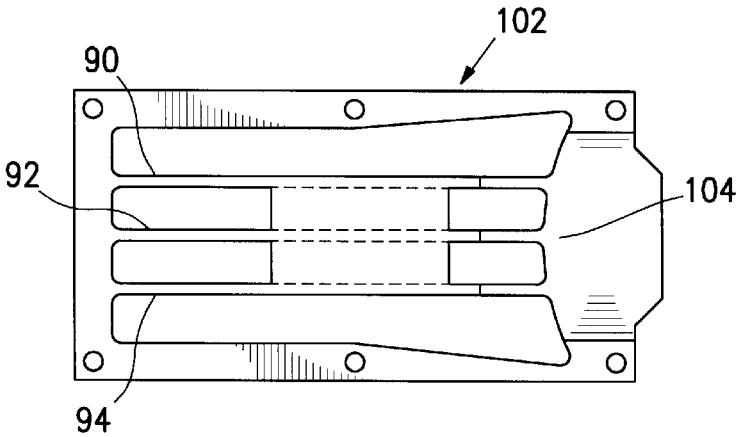
FIG. 11 is a bottom plan view of a portion of the water inlet system shown in FIG. 10.
Figure 12:
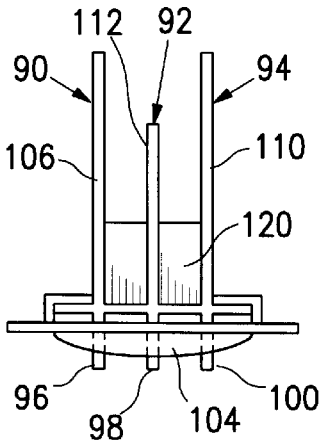
FIG. 12 is an aft elevational view of a portion of the water inlet system shown in FIG. 10.

Referring now to FIGS. 10–12, yet another embodiment is illustrated. This embodiment includes three panels 90, 92 and 94 with three integral fins 96, 98 and 100, respectively. The three panels and the three fins are integrally connected with a grate 102 which includes a scoop 104 as described in relation to the earlier two embodiments. The shapes of the panels 90 and 94 are essentially identical to the panels 70 and 72, FIG. 7, while the middle panel 92 is essentially the same as panel 46 FIG. 3. As mentioned earlier the integrated panels, fins and grate are attached to the bottom of a watercraft with the upper surfaces of the panels, such as a surface 106 of the panel 90, being positioned against or mated with the upper wall 45 of the channel 44. A top wall 112 of the center panel 92 is positioned adjacent or mated to the impeller shaft housing 48.

In addition to having three panels, the FIGS. 10–12 embodiment differs from earlier embodiments by having a ramp structure 114, a flat bottom surface 116, a slanted top surface 118 and an aft surface 120. The purpose of the ramp is to divide the flow of incoming water in a vertical direction so as to direct flow to both the upper and lower portions of the impeller. Another commonly used name for the ramp structure is "top loader."

Figure 13:
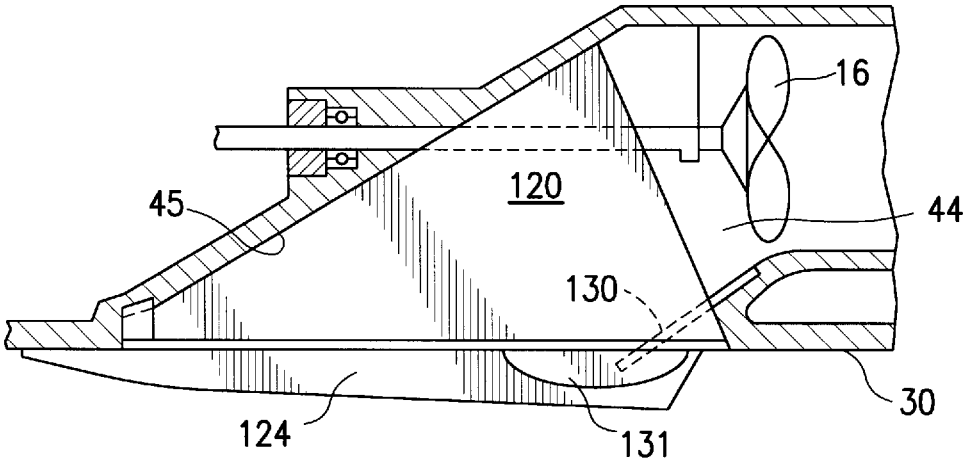
FIG. 13 is a diagrammatic side elevational view of still another embodiment of the inventive water inlet system.
Figure 14:
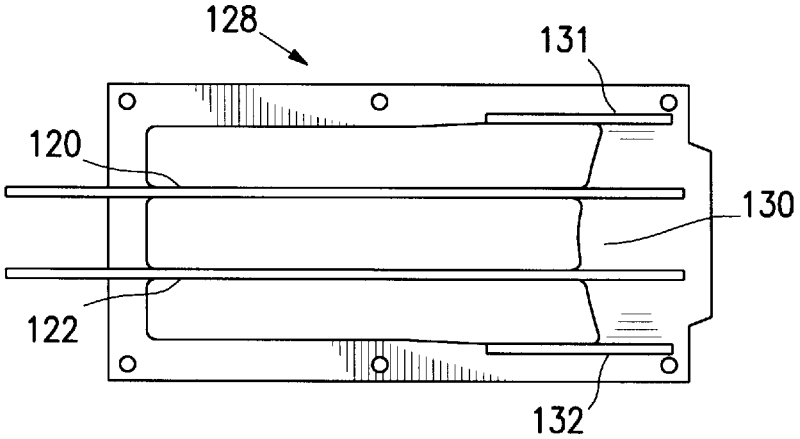
FIG. 14 is a bottom plan view of a portion of the water inlet system shown on FIG. 13.
Figure 15:
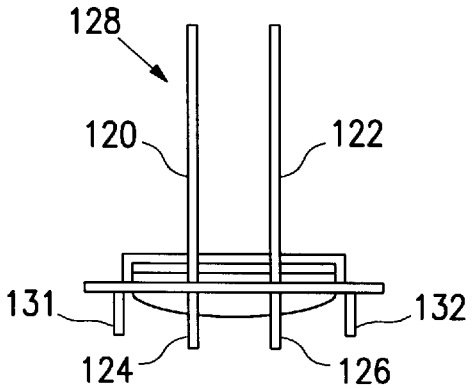
FIG. 15 is an aft elevational view of a portion of the water inlet system shown in FIG. 13.

Referring now to FIGS. 13–15, yet another embodiment of the water inlet system is illustrated. This embodiment is very similar to the embodiment shown in FIGS. 7–9, with two panels 120 and 122, two integral fins 124 and 126, respectively, a grate 128 and a scoop 130. This embodiment, however, includes outer fins, such port fin 131 and starboard fin 132. These are relatively short in a longitudinal direction when compared to the more centrally disposed fins 124 and 126. In addition, the two central fins 124 and 126 are longer than those shown in previous embodiments and extend forward of the panel as best seen in FIGS. 13 and 14. The forward portion of the fins may extend 5 to 6 inches forward of the grate, or more, depending upon the size of the watercraft. The longer fins are more efficacious in moving vegetation and debris pass the craft. As before, the panels, fins, frame and scoop may be formed integrally.

Figure 16:
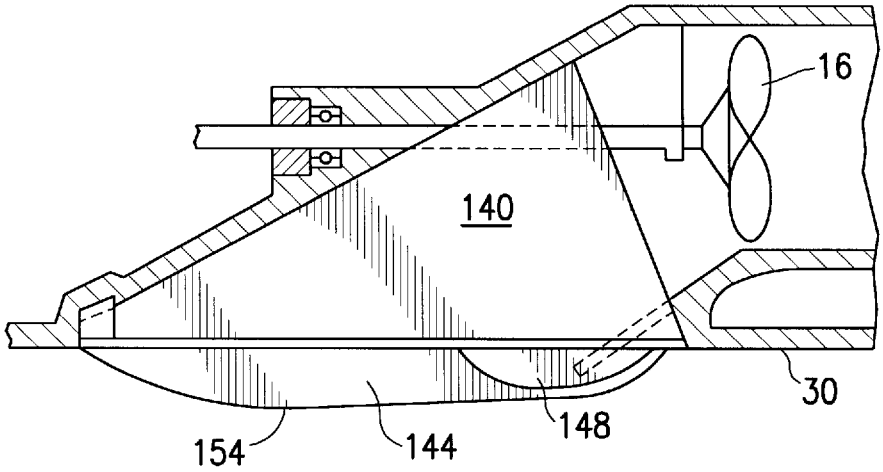
FIG. 16 is a diagrammatic side elevational view of a further embodiment of the inventive water inlet system.
Figure 17:
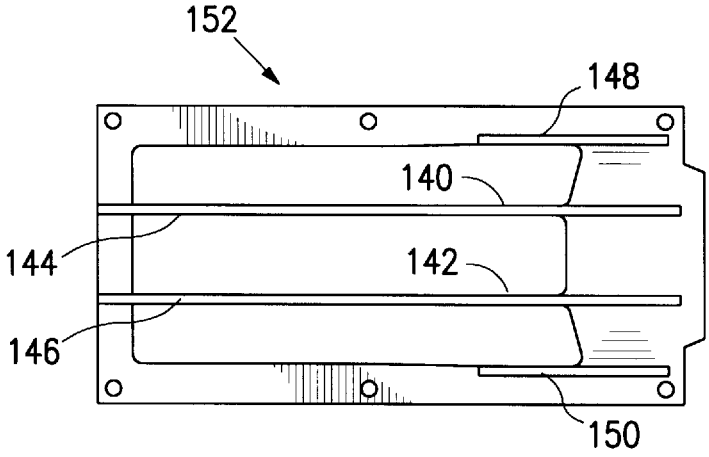
FIG. 17 is a bottom plan view of a portion of the water inlet system shown in FIG. 16.

A still further embodiment of the inventive device is shown in FIGS. 16 and 17. The FIGS. 16 and 17 embodiment includes two triangular panels 140 and 142, two inner fins 144 and 146 and two outer fins 148 and 150. Once again the fins and the panels may be integral with the frame to form a grate 152, and the grate may be attached to the bottom of a watercraft. Attention is directed to FIG. 16 where the larger fins, such as the fin 144, has a lowest point or region about the location marked with a numeral 154. It has been found that by moving this "lowest point" forward, vegetation and debris is even less likely to adhere to the water inlet system.

Figure 18:
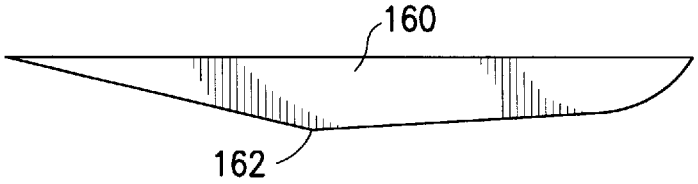
FIG. 18 is a side elevational view of another embodiment of a fin for the inventive water inlet system.
Figure 19:
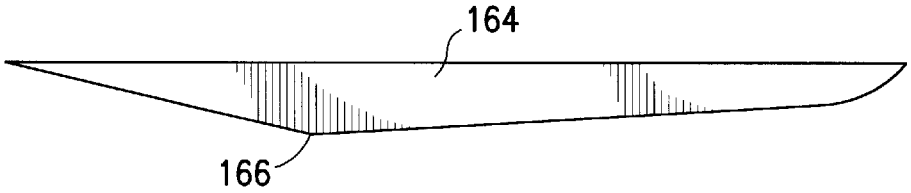
FIG. 19 is a side elevational view of yet another embodiment of a fin for the inventive water inlet system.
Figure 20:
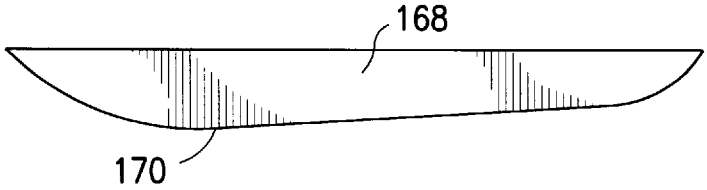
FIG. 20 is a side elevational view of still another embodiment of a fin for the inventive water inlet system.

Other configurations for the fins may be seen by reference to FIGS. 18–20. The drawings illustrate three additional embodiments of fin structures. In FIG. 18, a fin 160 extends forward of the inlet and has a lowest point 162 forward of its longitudinal center point. In FIG. 19, a fin 164 extends longitudinally forward and aft of the inlet and also has its lowest point 166 in a more forward position. Shown in FIG. 20 is a fin 168 which extends rearwardly of the inlet but not forwardly and which has a lowest point 170 in a more forward position.

Figure 21:
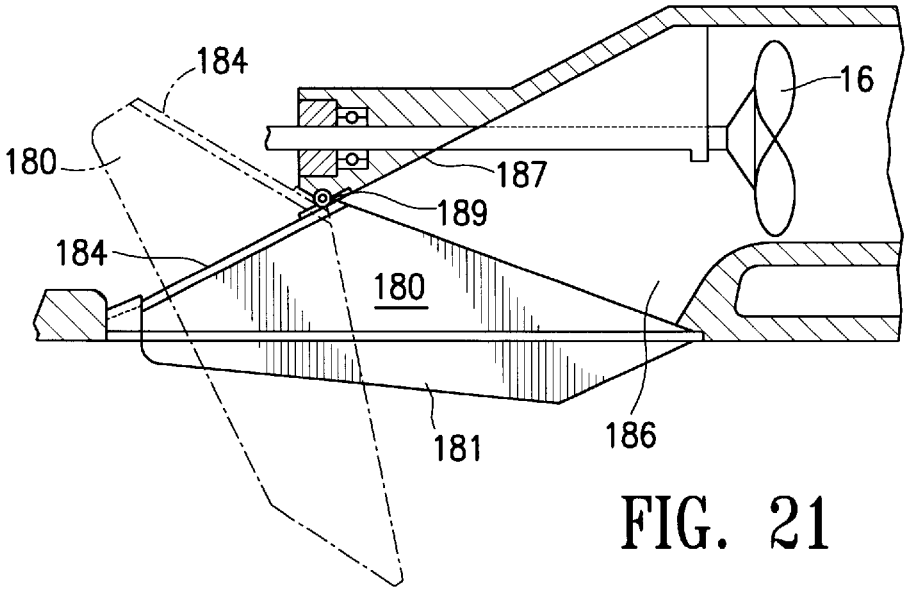
FIG. 21 is a diagrammatic side elevational view partially in phantom line showing another embodiment of the inventive water inlet system.
Figure 22:
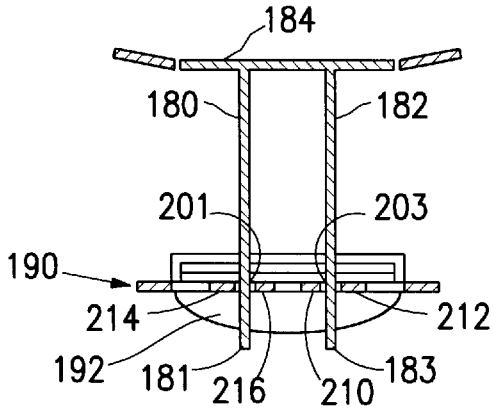
FIG. 22 is an aft sectional elevational view of the water inlet system shown in FIG. 21.
Figure 23:
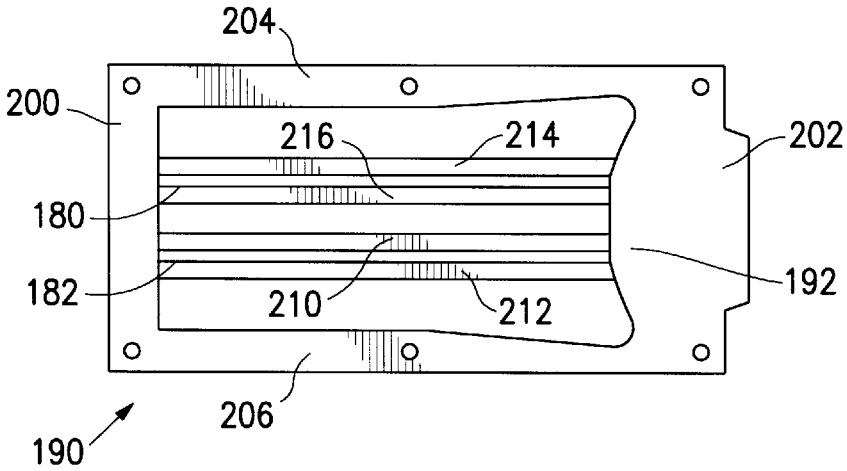
FIG. 23 is a bottom plan view of a portion of the water inlet system of FIG. 21.

Referring now to FIGS. 21–23 there is illustrated a further embodiment of the inventive water inlet system in which panels 180 and 182 are integral with or affixed to a movable upper wall 184 of a water channel 186. Each panel includes an integral fin such as the fins 181 and 183, respectively. Unlike the embodiments already described, the upper wall 184 is pivotal relative to a fixed wall portion 187 of the craft. The pivotal relationship is accomplished by a hinge 189. The hinge allows the upper wall to act like a trap door, movable from a lowered position shown in solid lines in FIG. 21 to a raised position shown in phantom lines. The use of this concept allows a boat operator to open the upper wall and clean any debris that may be located in the water channel. Seals (not shown) may be used around the upper wall to prevent water from entering the craft.

There is also a self-cleaning feature in the embodiment shown in FIGS. 21–23. As in the earlier described embodiments, there is a frame 190 with a scoop 192, a fore member 200, an aft member 202, a port member 204 and a starboard member 206. In addition, two pairs of bars or ribs extend fore and aft between the members 200 and 202. The first pair of bars 214 and 216 cooperates with the panel 180. A second pair of bars 210 and 212 cooperates with the panel 182. As best seen in FIGS. 22 and 23, the panel-fin combinations are not attached to or integral with the frame. Rather, the panel-fins are received in slots 201, 203 between the two pairs of bars. This allows the frame to be fastened to the bottom of the craft while the panels are fixed or attached to the moveable wall 184. By causing the fins to pass between the pairs of bars any vegetation or debris clinging to the fins will be scraped off as the panels-fins are retracted or moved from their lowered position to their raised position as illustrated in FIG. 21. Scrapers or wiping seals (not shown) may also be incorporated with the bars at the slots.

Figure 24:
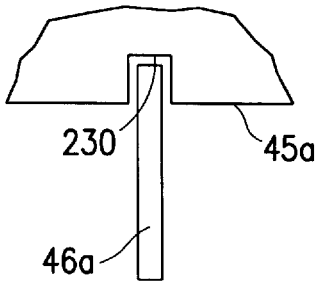
FIG. 24 is a partial aft elevational view showing one embodiment of the upper wall of the channel and the upper portion of a panel.
Figure 25:
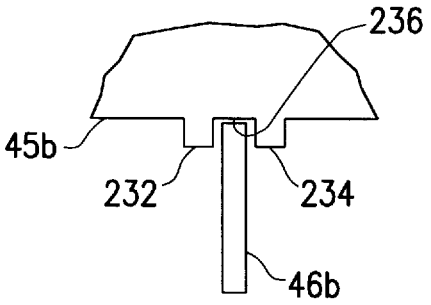
FIG. 25 is a partial aft elevational view showing another embodiment of the upper wall of the channel and the upper portion of a panel.
Figure 26:
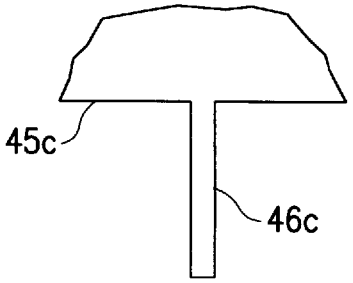
FIG. 26 is a partial aft elevational view showing still another embodiment of the upper wall and upper panel portion where they are integrated.

Referring now to FIGS. 24–26, there is illustrated three different variations for mating a panel to an upper wall of the water channel. For example, in FIG. 24, the upper wall 45*a* of the water channel has a recess in the form of a slot 230 into which the upper part of a panel 46*a* may be located. A variation of the relationship is shown in FIG. 25. There an upper wall 45*b* of the water channel includes two rails 232, 234 forming a channel shaped space 236 between them. This space receives the upper portion of a panel 46*b*. Referring now to FIG. 26, there is shown an upper wall 45*c* which is hinged, and a panel 46*c* formed to be integral with the wall or bonded or welded together. Other suitable geometries may be used where the panel and upper wall come together, if desired.

In operation, one embodiment of the grate is attached to the bottom of the watercraft by screws or bolts. In the five embodiments described above, FIGS. 3–17, attaching the grate to the bottom of the boat will align a properly dimensioned panel or panels with the upper wall of the water channel. At usual cruising speed, a watercraft will have it bow raised out of the water and cause the inlet opening to be at an angle to a referenced horizontal plane, such as the surface 32 of the body of water in which the watercraft is moving. This angled disposition facilitates the entry of water into the water channel. The upwardly raised bow also causes the depending fins to present a bottom edge that facilitates the movement of vegetation and debris along that edge rearwardly so as to pass the vegetation and debris by the watercraft.

With regard to the embodiment shown in FIGS. 21–23, the same aspect of the fins will be exposed to vegetation and debris, and the integrated panels will operate in the same way in that vegetation and debris will have little to wrap around or wedge against and thus become entangled. Most of the vegetation and debris will simply impinge upon the bottom of the fin or fins and be pushed aft by the force of the water passing the bottom of the craft. Vegetation or debris that enters the water channel will be sucked toward and through the impeller and out the exhaust. There is little protruding structure on which the vegetation or debris can become stuck.

In the embodiments shown in FIGS. 3–20 should any debris be entangled, cleaning would take place in the usual manner.

With the embodiment shown in FIGS. 21–23, cleaning is facilitated by the hinged arrangement of the panels. The upper wall 184 is rotated upwardly analogous to the operation of a trap door to expose the panels and the frame to an operator in the craft. In this way, cleaning can take place from inside the watercraft. Also, the act of rotating the upper wall causes the panels to scrape against the bars of the frame and this action also removes vegetation or debris which might have adhered to the fins.

What has been described is a very efficient, reliable and inexpensive means to prevent or restrict the clogging of jet drive water channels due to aquatic vegetation and debris.

The present specification describes in detail several embodiments of the invention. Other modifications and variations will, under the Doctrine of Equivalents, come within the scope of the appended claims. For example, a system having more panels than the embodiments disclosed here is an equivalent. A system having panels of greater thickness is also equivalent, or, a system having a water inlet of different shape or geometry is an equivalent structure and is intended to come within the claims that follow. Obviously, other variations will also be equivalent, and there is no intention to limit in any way the application of the Doctrine of Equivalents.

We claim:

1. A marine jet propulsion water inlet system that resists clogging by aquatic vegetation and debris comprising:

a water channel extending in upstream and downstream directions disposed in a watercraft, the channel having an upstream inlet in communication with an opening in a bottom of the watercraft, with the channel extending downstream for passing water from outside the watercraft through the channel to an impeller mounted to the watercraft;

the channel having an upper wall;

a vertically disposed panel within the channel extending from the upper wall and from the inlet in a direction downstream toward the impeller; and an upstream directed, extending fin connected to the panel and being disposed upstream of the inlet.

2. A system as claimed in claim 1 including:

a grate adapted to be connected to the bottom of the watercraft.

3. A system as claimed in claim 2 including:

said fin being disposed upstream of the grate.

4. A system as claimed in claim 3 wherein:

the watercraft has a longitudinal axis with fore and aft directions; and including:

the fin extending in a direction parallel to the longitudinal axis of the watercraft upstream of the grate and forward of the grate along the bottom of the watercraft.

5. A system as claimed in claim 3 wherein:

the water craft has a longitudinal axis with fore and aft direction; and including:

the fin extending in a direction parallel to the longitudinal axis of the watercraft upstream of the grate and aft of the grate along the bottom of the watercraft.

6. A system as claimed in claim 5 wherein:

the fin extends in a direction parallel to the longitudinal axis forward and aft of the grate and has fore and aft ends.

7. A system as claimed in claim 6 wherein:

the fin having a lowest portion nearer the fin fore end than the fin aft end.

8. A system as claimed in claim 1 wherein:

the panel is integral with the upper wall of the channel.

9. A system as claimed in claim 1 including:

a grate adapted to be connected to the watercraft; and wherein the panel is integral with the upper wall of the channel.

10. A system as claimed in claim 1 wherein:

the panel is constrained by the upper wall of the channel.

11. A system as claimed in claim 1 including:

a second vertically disposed panel extending from the upper wall and from the inlet downstream to the impeller, the second panel being parallel with the first mentioned panel.

12. A system as claimed in claim 11 including:

a second upstream directed, extending fin connected to the second panel and being disposed upstream of the inlet.

13. A system as claimed in claim 12 including:

a grate adapted to be connected to the watercraft.

14. A system as claimed in claim 13 wherein:

the grate, the panels and the fins are integrally connected.

15. A system as claimed claim 3 wherein:

the water craft has a longitudinal axis with fore and aft direction;

the fin extends in a direction parallel to the longitudinal axis of the watercraft and has fore and aft ends, said fin having a furthest upstream point nearer the fin fore end than the fin aft end.

16. A system as claimed in claim 1 including:

a second vertically disposed panel extending from the upper wall and from the inlet downstream toward the impeller;

a second upstream directed, extending fin connected to the second panel;

a grate adapted to be connected to the bottom of the watercraft; and a scoop connected to the grate for directing water into the channel.

17. A system as claimed in claim 16 wherein:

the gate is connected to the panels.

18. A method for forming a marine jet propulsion water inlet system that resists clogging by aquatic vegetation and debris comprising:

forming in a watercraft a water channel having an upper wall;

communicating a channel upstream inlet with an opening in the bottom of the watercraft;

extending the channel downstream for allowing the passage of water from outside the watercraft through the channel to an impeller mounted to the watercraft;

forming a panel within the channel;

forming a fin connected to the panel, the fin extending upstream of the inlet, and extending the panel from the upper wall and the inlet, downstream toward the impeller.

19. A method as claimed in claim including:

forming a grate to cooperate with the panel.

20. A system as claimed in claim 19 including:

integrally forming the grate, the panel and the fin.

21. A system as claimed in claim 18 including:

forming a second panel within the channel;

extending the second panel from the upper wall and the inlet, downstream toward the impeller;

forming a grate to cooperate with the two panels; and forming two fins one each connected to one of the panels, the fins extending upstream of the inlet.

22. A method as claimed in claim 21 including:

forming a scoop connected to the grate for directing water to said channel.

* * * * *